US009556612B2

(12) United States Patent
Bottin

(10) Patent No.: US 9,556,612 B2
(45) Date of Patent: Jan. 31, 2017

(54) FLOOR ASSEMBLY FOR MODULAR BUILDING UNITS

(71) Applicant: Herve Bottin, La Baule (FR)

(72) Inventor: Herve Bottin, La Baule (FR)

(73) Assignee: Williams Scotsman, Inc., Baltimore, MD (US)

( * ) Notice: Subject to any disclaimer, the term of this patent is extended or adjusted under 35 U.S.C. 154(b) by 0 days.

(21) Appl. No.: 14/802,112

(22) Filed: Jul. 17, 2015

(65) Prior Publication Data

US 2016/0017601 A1 Jan. 21, 2016

Related U.S. Application Data

(60) Provisional application No. 62/026,287, filed on Jul. 18, 2014.

(51) Int. Cl.
*E04H 1/00* (2006.01)
*E04B 5/02* (2006.01)
(Continued)

(52) U.S. Cl.
CPC ..... *E04B 5/023* (2013.01); *E04B 1/1903* (2013.01); *E04B 1/343* (2013.01); *E04B 5/10* (2013.01);
(Continued)

(58) Field of Classification Search
CPC ..... E04B 5/023; E04B 5/10; E04B 1/1903; E04B 1/343; E04B 2001/34389; E04H 1/005; E04H 1/12; E04H 2001/1283
(Continued)

(56) References Cited

U.S. PATENT DOCUMENTS 1,522,200 A 1/1925 Masury
1,867,433 A * 7/1932 Young ..... E04B 5/48 105/401
(Continued)

FOREIGN PATENT DOCUMENTS

CA 2455071 5/2005
CN 104018583 9/2014
(Continued)

OTHER PUBLICATIONS

ModSpace. "Oil & Natural Gas Buildings" http://www.modspace.com/modular-solutions/modular-buildings/industrialenergy/oil-natura . . . Mar. 3, 2015.

*Primary Examiner* — Basil Katcheves
*Assistant Examiner* — Joshua Ihezie
(74) *Attorney, Agent, or Firm* — Whiteford, Taylor & Preston, LLP; Gregory M. Stone

(57) ABSTRACT

Disclosed is a floor assembly for a modular building unit that avoids the need to turn the floor assembly frame over for installation of a floor subsheet, and that likewise provides a modular floor subsheet that may be fitted to the modular building unit without welding, rivets, screws, or other tooling. A floor assembly frame includes side rails that form the exterior, bottom perimeter of the modular building unit, and joists that extent between parallel side rails of the floor assembly frame. The joists are configured at their base on one side with a slot configured to receive one end of a section of a floor subsheet. An opposite end of the floor subsheet is then positioned overtop the joist element that forms the top portion of the slot on an adjacent joist, which opposite end may then be held in place with a pin, clip, or other fastener requiring minimal effort to install. Such assembly allows all components of the floor to be installed from above, thus avoiding the need to invert the frame of the floor assembly during installation. Likewise, the modular
(Continued)

nature of the assembly allows installation to be carried out by fewer personnel than required in traditional installations.

18 Claims, 8 Drawing Sheets

(51) Int. Cl.

| | |
|---|---|
| ***E04B 1/19*** | (2006.01) |
| ***E04B 5/10*** | (2006.01) |
| ***E04B 1/343*** | (2006.01) |
| ***E04C 3/07*** | (2006.01) |
| *E04H 1/12* | (2006.01) |
| *E04B 1/348* | (2006.01) |
| *E04B 9/06* | (2006.01) |
| *E04B 9/24* | (2006.01) |
| *E04C 3/04* | (2006.01) |

(52) U.S. Cl.
CPC ..... *E04C 3/07* (2013.01); *E04B 1/3483* (2013.01); *E04B 9/065* (2013.01); *E04B 9/241* (2013.01); *E04B 2001/34389* (2013.01); *E04C 2003/0421* (2013.01); *E04C 2003/0434* (2013.01); *E04C 2003/0473* (2013.01); *E04H 2001/1283* (2013.01)

(58) Field of Classification Search
USPC ..... 52/79.9
See application file for complete search history.

(56) References Cited

U.S. PATENT DOCUMENTS 1,913,342 A * 6/1933 Schaffert ..... E04D 3/30 105/422
2,151,148 A * 3/1939 Plumb ..... E04C 2/044 52/405.3
2,421,978 A 6/1947 Andrews
2,787,028 A 4/1957 Webb
3,134,468 A * 5/1964 Toti ..... E04F 10/08 52/478
3,224,151 A 12/1965 Nystrom
3,332,197 A * 7/1967 Hinkle ..... E04C 3/06 47/33
3,461,633 A * 8/1969 Ziegelman ..... E04B 1/24 52/643
3,609,933 A * 10/1971 Jahn et al. ..... E04B 2/60 52/346
3,708,932 A * 1/1973 Bailey ..... E04B 9/008 52/232
3,830,027 A 8/1974 Paisley et al.
3,971,172 A * 7/1976 Gentil ..... E04B 1/24 52/219
4,100,703 A 7/1978 Stickler
4,100,711 A * 7/1978 Skuran ..... E04C 2/292 52/489.2
4,120,131 A * 10/1978 Carroll ..... E04B 1/164 52/310
4,364,206 A * 12/1982 Wybauw ..... E04B 1/3483 52/185
4,507,901 A * 4/1985 Carroll ..... E04B 7/00 52/220.1
4,545,159 A * 10/1985 Rizk ..... E04B 1/3483 52/143
4,599,829 A * 7/1986 DiMartino, Sr. ..... E04B 1/3483 410/79
4,637,763 A 1/1987 Van Iperen
4,644,708 A 2/1987 Baudot et al.
4,875,595 A 10/1989 Van Valkenburg
4,893,446 A * 1/1990 Gudmundsson ..... E04B 2/825 52/238.1
4,931,340 A * 6/1990 Baba ..... B32B 3/12 108/51.11
5,004,269 A 4/1991 Pelt
5,011,152 A 4/1991 Hugunin
5,145,309 A 9/1992 Foster
5,193,325 A 3/1993 Allison
5,317,857 A 6/1994 Allison
5,671,855 A 9/1997 Norman et al.
5,737,892 A * 4/1998 Greenberg ..... E04D 3/366 52/469
5,755,063 A * 5/1998 Ohnishi ..... E04B 1/3483 52/127.2
5,950,385 A * 9/1999 Herren ..... E04B 2/7453 52/479
5,966,956 A 10/1999 Morris et al.
5,992,112 A * 11/1999 Josey ..... E04B 1/34347 52/309.8
6,003,279 A * 12/1999 Schneider ..... E04B 1/0046 403/230
6,145,257 A * 11/2000 Cappuccio ..... E04B 2/8647 52/220.2
6,155,747 A 12/2000 Payne et al.
6,179,522 B1 1/2001 Sanford et al.
6,279,955 B1 8/2001 Fisher
6,299,008 B1 10/2001 Payne
6,327,828 B1 12/2001 Carroll
6,354,045 B1 * 3/2002 Boone ..... E04D 3/366 52/395
6,675,540 B1 * 1/2004 Rokes ..... E04B 1/34336 220/1.5
6,837,007 B2 1/2005 Floyd et al.
7,565,868 B2 * 7/2009 Relland ..... E02D 27/44 108/51.11
7,827,738 B2 11/2010 Abrams et al.
8,056,291 B1 * 11/2011 diGirolamo ..... E04B 5/19 52/250
8,096,084 B2 * 1/2012 Studebaker ..... E04B 1/003 52/250
8,397,441 B2 3/2013 Wallance
8,402,704 B2 3/2013 Hartley et al.
8,561,367 B2 10/2013 Kelly
8,642,900 B2 2/2014 Nordling et al.
2005/0210762 A1 * 9/2005 Broberg ..... E04B 1/34807 52/79.1
2005/0257494 A1 11/2005 Brandes
2006/0037280 A1 2/2006 Smith
2007/0138173 A1 6/2007 Nielsen
2007/0271857 A1 * 11/2007 Heather ..... B65D 88/005 52/79.9
2008/0178505 A1 * 7/2008 Tumlinson ..... G09F 7/18 40/607.01
2008/0251403 A1 10/2008 Nielsen
2009/0223143 A1 9/2009 Eposito
2009/0223153 A1 9/2009 Macgregor
2009/0229194 A1 9/2009 Armillas
2011/0016801 A1 * 1/2011 Ziegelman ..... E04B 1/3483 52/79.9
2011/0016802 A1 * 1/2011 Wallance ..... E04B 1/003 52/79.9
2011/0203919 A1 * 8/2011 Maldonado Ramirez Arellano ..... C25C 7/00 204/275.1
2011/0260533 A1 10/2011 Hardin
2011/0271609 A1 * 11/2011 Lewis ..... E04B 1/7654 52/143
2011/0297675 A1 12/2011 Johnson et al.
2012/0006369 A1 1/2012 Cantin
2012/0037198 A1 2/2012 Cantin et al.
2012/0077429 A1 3/2012 Wernimont et al.
2012/0255241 A1 10/2012 Nishikawa et al.
2012/0306236 A1 12/2012 Skipper et al.
2013/0067846 A1 * 3/2013 Kvols ..... E04H 1/1205 52/586.1
2013/0232886 A1 * 9/2013 Yoder ..... E04B 1/34315 52/79.1
2014/0000183 A1 1/2014 Parren et al.
2014/0044914 A1 * 2/2014 Kurtz ..... B32B 3/28 428/74
2014/0090312 A1 4/2014 Medley

(56) References Cited

U.S. PATENT DOCUMENTS

| | | | |
|---|---|---|---|
| 2014/0213169 | A1 | 7/2014 | Rasmussen et al. |
| 2014/0259971 | A1 | 9/2014 | Bikker |
| 2014/0298745 | A1 | 10/2014 | Rechenmacher et al. |
| 2015/0033639 | A1 | 2/2015 | Wilson |
| 2015/0075271 | A1 | 3/2015 | Tracy et al. |
| 2015/0101258 | A1 | 4/2015 | Milo et al. |
| 2015/0152634 | A1 | 6/2015 | Unger |
| 2015/0159363 | A1* | 6/2015 | Ehsasi ..... E04H 1/1205 52/79.5 |
| 2015/0259938 | A1 | 9/2015 | Bernard |

FOREIGN PATENT DOCUMENTS

| | | | |
|---|---|---|---|
| CN | 203878747 | U | 10/2014 |
| EP | 2674538 | A1 | 12/2013 |
| EP | 2674538 | B1 | 12/2014 |
| GB | 2062060 | | 5/1981 |
| WO | 93/11328 | | 6/1993 |
| WO | 93/19262 | | 6/1993 |
| WO | 9506609 | | 3/1995 |
| WO | 97/44541 | | 11/1997 |
| WO | 2008/027234 | | 3/2008 |
| WO | 2011/113102 | | 9/2011 |
| WO | 2012/068800 | | 5/2012 |
| WO | 2013159772 | | 10/2013 |

* cited by examiner

FLOOR ASSEMBLY FOR MODULAR BUILDING UNITS

CROSS REFERENCE TO RELATED APPLICATION

This application is based upon and claims benefit of U.S. Provisional Patent Application Ser. No. 62/026,287 entitled "Floor Subsheet For Modular Building Units," filed with the U.S. Patent and Trademark Office on Jul. 18, 2014 by the inventor herein, the specification of which is incorporated herein by reference in its entirety.

FIELD OF THE INVENTION

This invention relates generally to modular building construction, and more particularly to a floor assembly for use in a modular building unit.

BACKGROUND OF THE INVENTION

Modular buildings typically comprise a skeletal metal (e.g., steel) frame that supports a number of elements allowing easy transportation, construction, and customization of the building unit. Those elements typically include a solid roof and floor and wall panels that are inserted into the frame. In order to provide access into the building unit, a door is typically provided on at least one of the walls of the building unit. The floor assembly typically comprises an elongate sheet that must be attached to the structural frame by first turning the floor assembly upside-down, installing flooring sheet on the bottom of the frame, and then turning the floor assembly right-side-up so that the flooring sheet is facing the ground. This is a time consuming and labor intensive process, typically requiring multiple personnel to manipulate the sizable floor assembly.

Thus, there remains a need in the art for a modular building unit construction having a floor assembly that would offer a modular assembly allowing easier assembly than prior known floor assemblies, that could be installed without a team of installation personnel, and particularly that can be installed without requiring that the floor assembly frame be inverted during setup of the modular building unit.

SUMMARY OF THE INVENTION

Disclosed is a floor assembly for a modular building unit that avoids the need to turn the floor assembly frame over for installation of a floor subsheet, and that likewise provides a modular floor subsheet that may be fitted to the modular building unit without welding, rivets, screws, or other tooling. A floor assembly frame includes side rails that form the exterior, bottom perimeter of the modular building unit, and joists that extent between parallel side rails of the floor assembly frame. The joists are configured at their base on one side with a slot configured to receive one end of a section of a floor subsheet. An opposite end of the floor subsheet is then positioned overtop the joist element that forms the top portion of the slot on an adjacent joist, which opposite end may then be held in place with a pin, clip, or other fastener requiring minimal effort to install. Such assembly allows all components of the floor to be installed from above, thus avoiding the need to invert the frame of the floor assembly during installation. Likewise, the modular nature of the assembly allows installation to be carried out by fewer personnel than required in traditional installations.

In accordance with certain aspects of an embodiment of the invention, a floor assembly for a modular building unit is disclosed, comprising: bottom rails forming a perimeter of the floor assembly; and a plurality of floor joists extending between two of the bottom rails, each floor joist further comprising a bottom generally horizontal wall, a horizontal slot wall above the bottom wall extending over a portion of the bottom wall and forming a slot between the slot wall and the bottom wall, a vertical wall extending upward from the slot wall, and a top horizontal floor support wall extending outward from the vertical wall; and a plurality of sub-floor sheets positioned between adjacent floor joists, wherein a first edge of a first sub-floor sheet is positioned within the slot, and wherein a second edge of the sub-floor sheet is positioned on a top surface of the slot wall.

In accordance with further aspects of an embodiment of the invention, a modular building unit is disclosed, comprising: a rigid, fixed modular building unit frame having a plurality of corner support posts, a bottom rail extending between adjacent pairs of corner support posts and forming a perimeter of a floor assembly, a top rail extending between adjacent pairs of corner support posts, and a plurality of wall panels extending between the corner support posts, the top rails, and the bottom rails; and a plurality of floor joists extending between two of the bottom rails, each floor joist further comprising a bottom generally horizontal wall, a horizontal slot wall above the bottom wall extending over a portion of the bottom wall and forming a slot between the slot wall and the bottom wall, a vertical wall extending upward from the slot wall, and a top horizontal floor support wall extending outward from the vertical wall; and a plurality of sub-floor sheets positioned between adjacent floor joists, wherein a first edge of a first sub-floor sheet is positioned within the slot, and wherein a second edge of the sub-floor sheet is positioned on a top surface of the slot wall.

BRIEF DESCRIPTION OF THE DRAWINGS

The numerous advantages of the present invention may be better understood by those skilled in the art by reference to the accompanying drawings in which.

DETAILED DESCRIPTION OF THE PREFERRED EMBODIMENTS

The following description is of a particular embodiment of the invention, set out to enable one to practice an implementation of the invention, and is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
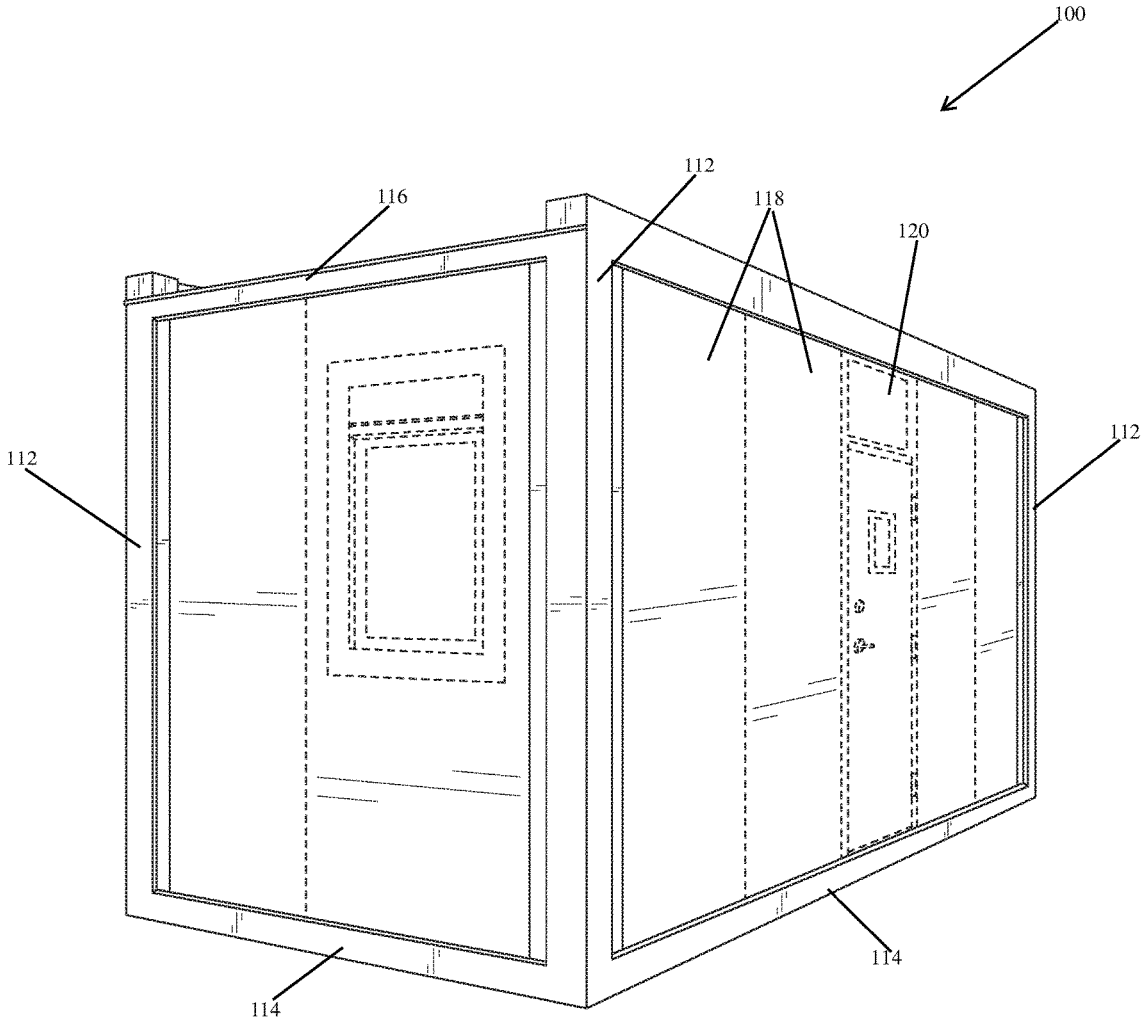
FIG. 1 is a perspective view of a modular building unit in accordance with certain aspects of an embodiment of the invention.

FIG. 1 provides a perspective view of a modular building unit 100 in accordance with certain aspects of an embodiment of the invention. Modular building unit 100 includes a skeletal frame formed by corner support posts 112, bottom rails 114, and top rails 116, wall panels 118, windows 120, and doors 120. This skeletal frame provides the key structural integrity for the modular building unit. As shown in FIG. 1, wall panels 118 are positioned between corner support posts 112, bottom rails 114, and top rails 116, which wall panels 118 form the wall structures spanning each side of the modular building unit.

Figure 2:
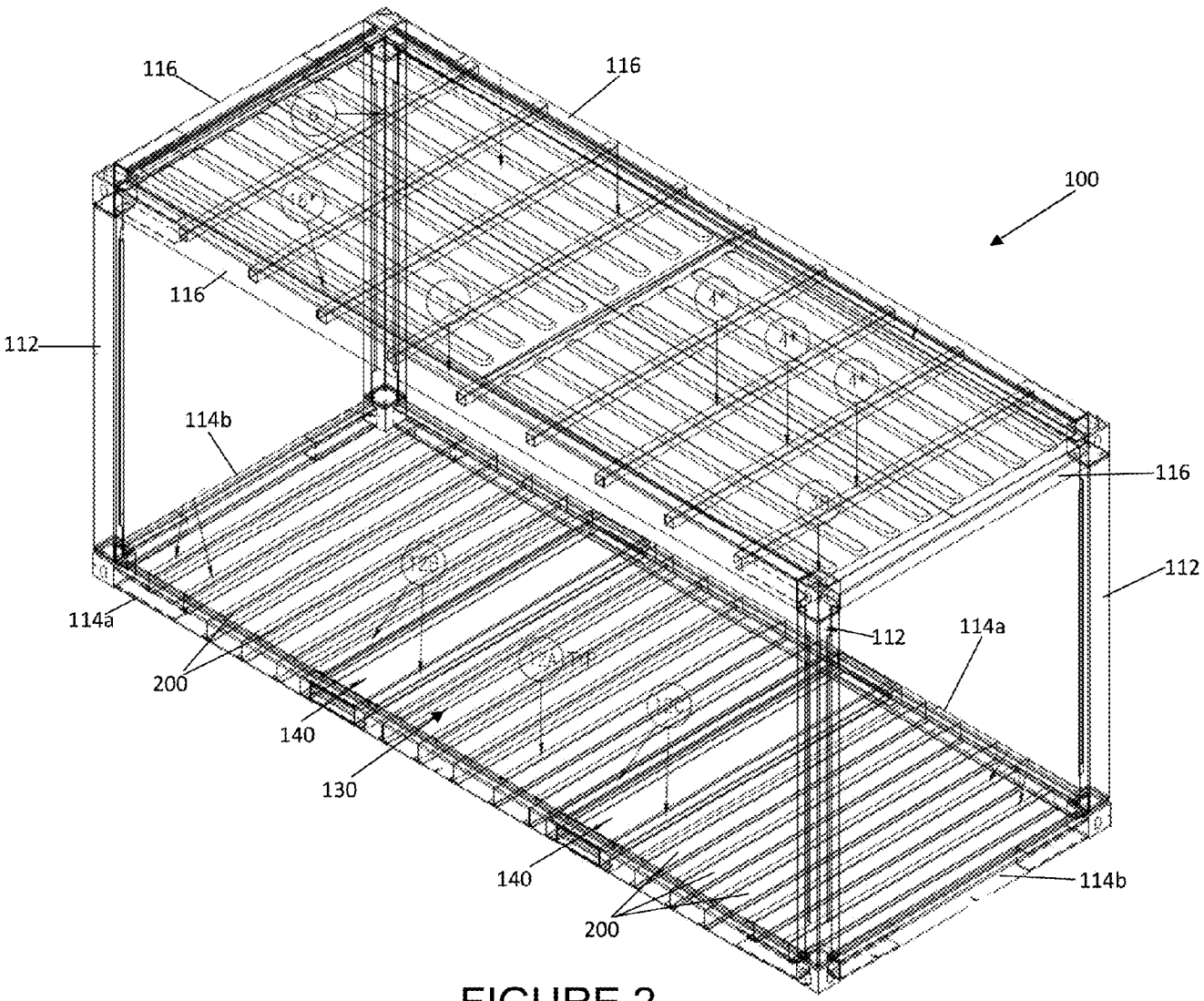
FIG. 2 is a perspective view of a skeletal frame of the modular building unit of FIG. 1.
Figure 3:
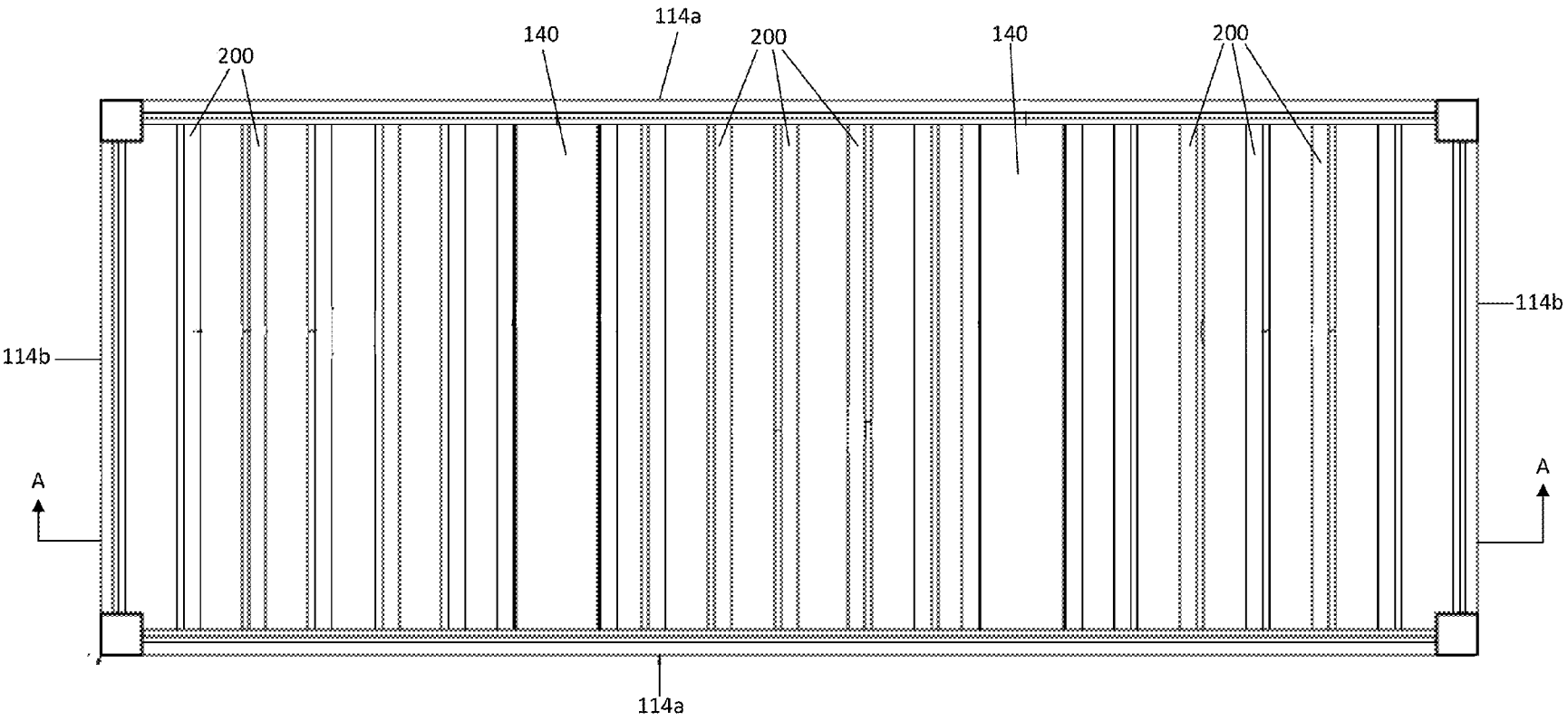
FIG. 3 is a top view of the floor assembly of the modular building unit of FIG. 1.

FIG. 2 is a perspective view of a skeletal frame of modular building unit 100, including a floor assembly 130 bordered by bottom rails 114, and more particularly by bottom long rails 114*a* and bottom short rails 114*b*. As shown in FIG. 2 and in the top view of floor assembly 130 of FIG. 3, floor assembly 130 includes floor joists 200 extending between bottom long rails 114*a* in a direction generally parallel to one another and to bottom short rails 114*b*. Additionally, forklift pockets 140 are preferably provided that open to the outside of bottom short rails 114*a* to allow insertion of the arms of a forklift to maneuver modular building unit 100.

Figure 5:
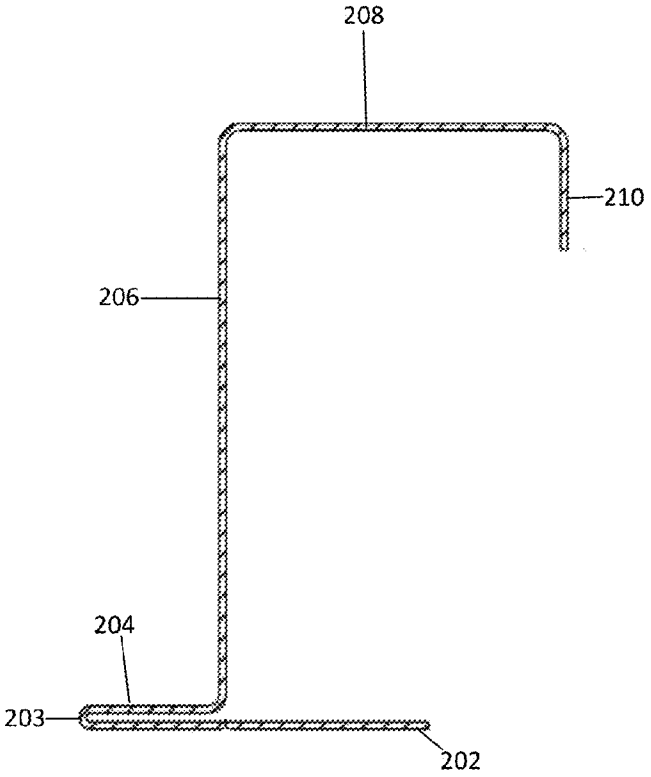
FIG. 5 is a cross-sectional view of the floor joist of FIG. 4.
Figure 4:
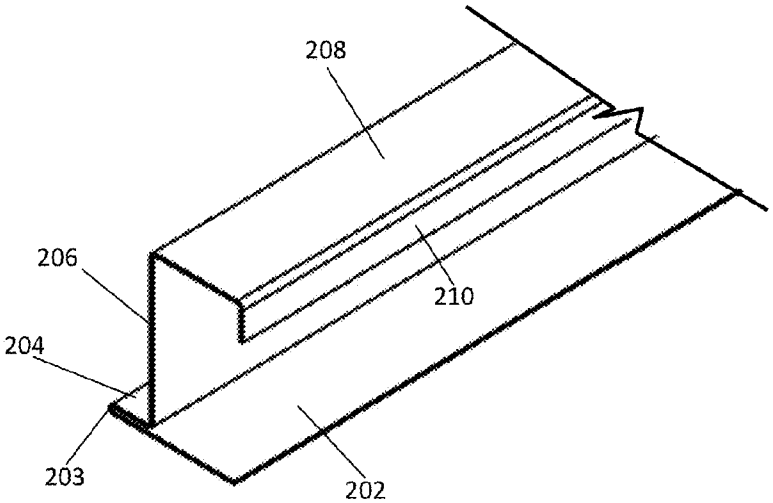
FIG. 4 is a perspective view of a first end of a floor joist for use with the floor assembly of FIG. 3.
Figure 7:
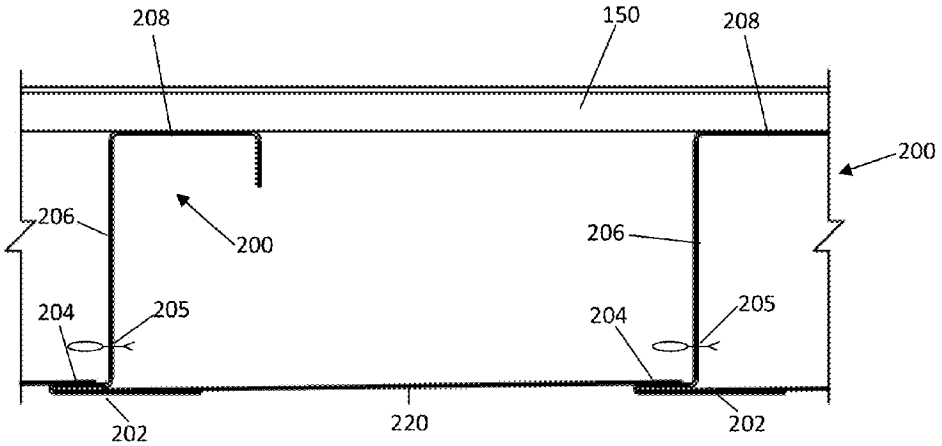
FIG. 7 is a close-up, cross-sectional view the floor assembly of FIG. 6.

Floor joists 200 provide the primary support for floor boards 150 (FIG. 7). As shown in the perspective view of a section of a floor joist 200 of FIG. 4, and in the cross-sectional view of the floor joist 200 of FIG. 5, each floor joist 200 has a bottom, generally horizontal wall 202 having a first free end and a second end terminating in an upward u-bend 203. U-bend 203 transitions into an upper slot wall 204, such that a slot is formed between the underside of slot wall 204 and the top side of horizontal wall 202. A vertical wall 206 extends upward from slot wall 204, and a top, horizontal floor support wall 208 extends outward from the top edge of vertical wall 206 to provide a support surface for the floor boards 150 of the modular building unit 100. A flange wall 210 may be provided extending downward from the free end of horizontal floor support wall 208.

Figure 6:
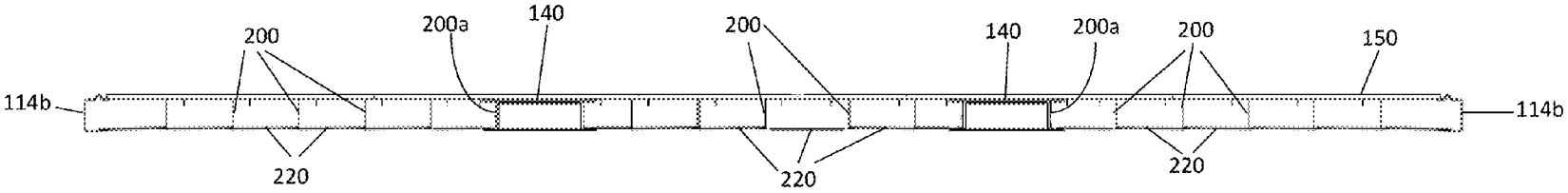
FIG. 6 is a cross-sectional view of floor assembly 130 along section line A-A of FIG. 3.

The slot formed between bottom, horizontal wall 202 and slot wall 204 is configured to receive an end of a sub-floor sheet 220, as shown in the cross-sectional views of floor assembly 130 of FIGS. 6 and 7. Floor joists 200 are positioned with the slots defined by slot wall 204 and bottom wall 202 opening to the right for joists on the left portion of floor assembly 130, and opening to the left for joists on the right portion of the floor assembly 130, with two joists facing one another at the center of the floor assembly 130. Of course, the two facing joists may be placed at a location other than in the center of floor assembly 130, as it is simply desirable to ensure that support surfaces are provided across the entire length of the floor assembly 130 for supporting separate sub-floor sheets 220. With particular reference to FIG. 6, sub-floor sheets 220 at the ends of floor assembly 130 are supported out their outer ends by the bottom portion of bottom short rails 114*b*, and are supported by facing floor joists 200*a* adjacent each forklift pocket 140.

With this configuration, and with particular reference to the close-up view of FIG. 7, each pair of floor joists 200 has a sub-floor sheet 220 positioned between them. A first end of the sheet 220 is positioned in the slot of a first floor joist 200 in the pair, and the second end sits on the slot wall 204 of the second floor joist 200 in the pair. The second end of the sheet 220 may then be held in place with, by way of non-limiting example, a clip 205, a pin, or any other fastener that may be installed without tools, so as to maximize the ease of installation. Alternatively, in those instances in which a more permanent installation is desired, sub-floor sheet 220 may be tack welded at various spots along the length of both bottom wall 202 and slot wall 204 of adjacent floor joists 200. In any case, the floor assembly may be installed without the need to invert the floor assembly 130 during the installation process.

Figure 8:
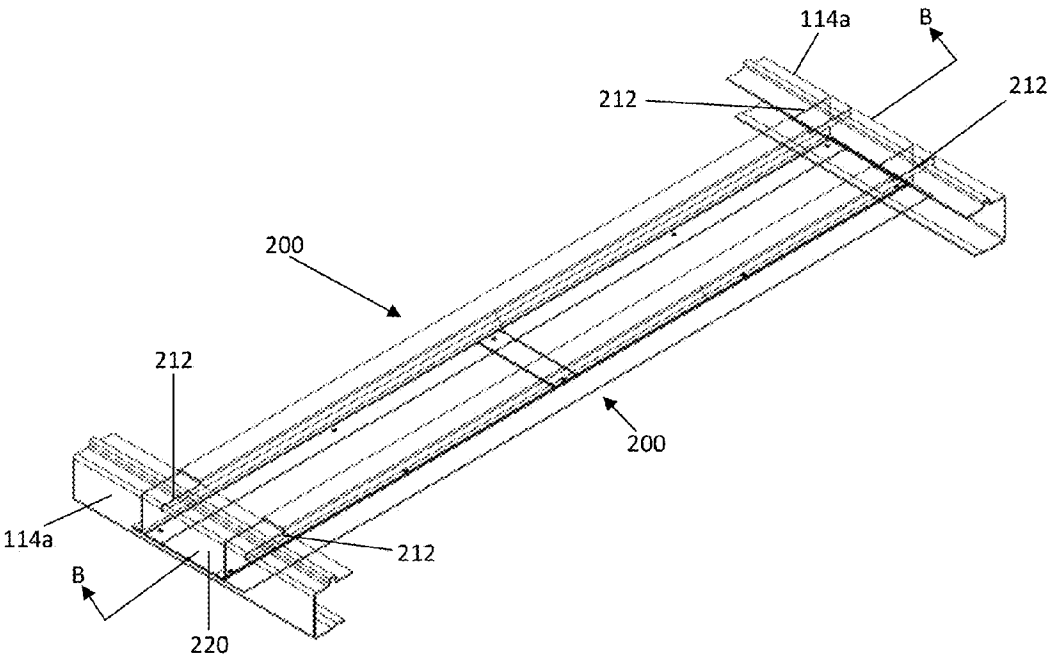
FIG. 8 is a perspective view of a section of the floor assembly showing two floor joists positioned within bottom long rails of the frame of FIG. 2.
Figure 9:
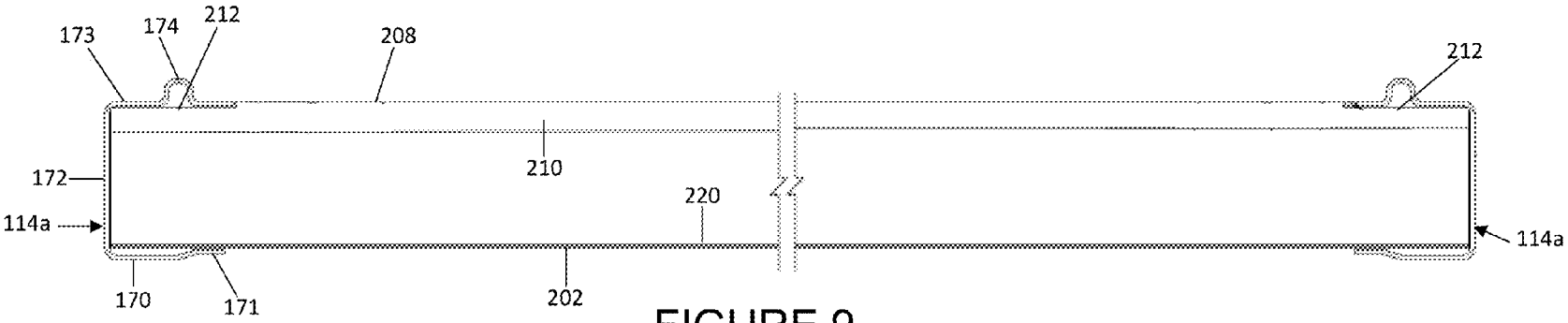
FIG. 9 is a cross-sectional view of the section of the floor assembly along section lines B-B of FIG. 8.
Figure 10:
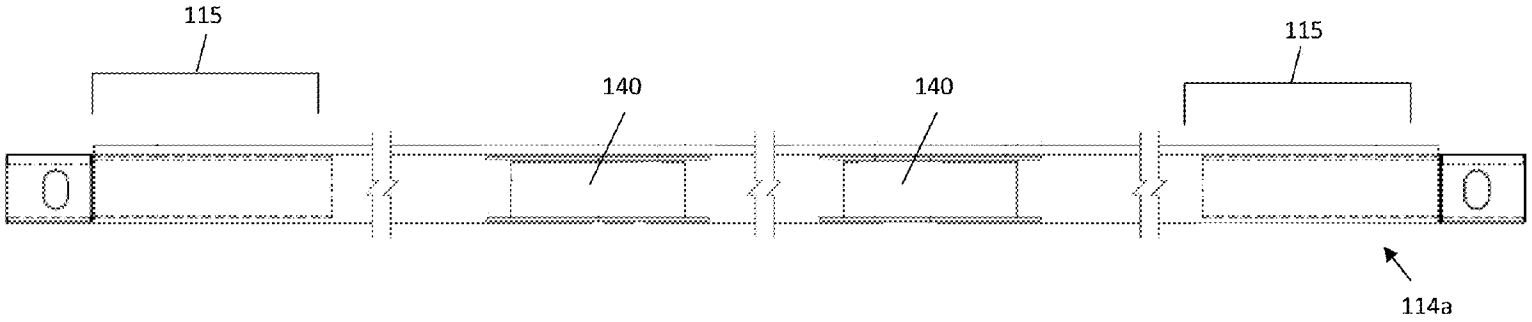
FIG. 10 is a side view of an interior of a bottom long rail for use with the frame of FIG. 2.
Figure 11:
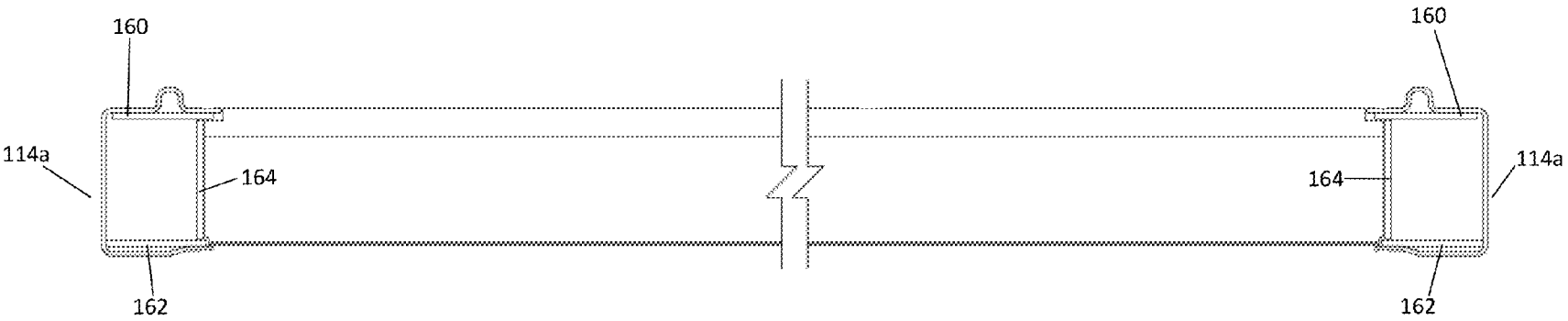
FIG. 11 is a cross-sectional view of two bottom long rails at an end region.
Figure 13:
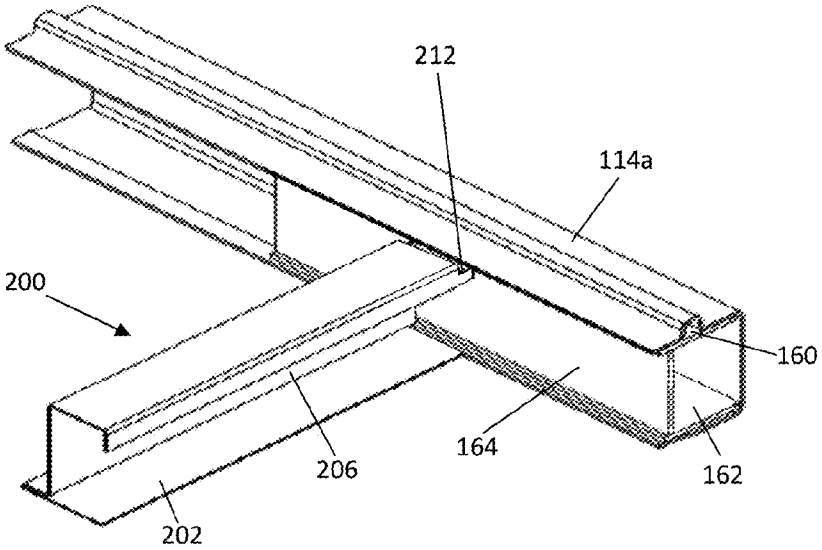
FIG. 13 is a perspective view of a floor joist attaching to a bottom long rail in a reinforced end region of the bottom long rail.
Figure 12:
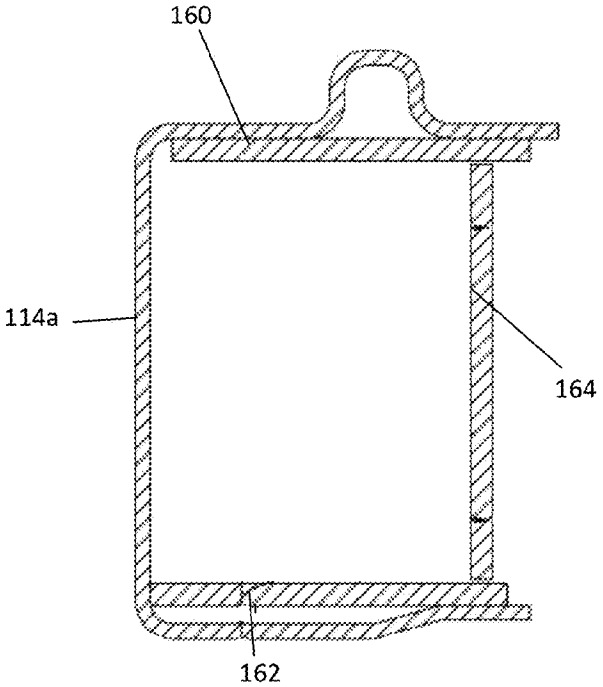
FIG. 12 is a cross-sectional view of a bottom long rail along section line C-C of FIG. 10.

FIG. 8 provides a perspective view of two floor joists 200 positioned within bottom long rails 114*a* of modular building 100, and FIG. 9 provides a cross-sectional view of the floor assembly 130 along section line B-B of FIG. 8. Each joist 200 extends between and generally perpendicular to bottom long rails 114*a*. Bottom long rails 114*a* each have a bottom face 170 having an upwardly bent portion 171 at a distal end which positions the bottom wall 202 of floor joists 200, and thus the bottom surface of sub-floor sheets 220, above the surface on which modular building unit 100 is positioned. Bottom long rails 114*a* also have an exterior vertical wall 172 that extends upward from bottom face 170 and forms the exterior bottom perimeter of modular building unit 100, and a top wall 173 extending inward from the top portion of vertical wall 172. Top wall 173 is provided an upwardly directed ridge that is configured to releasably engage a notch on the bottom surface of a wall panel, as described in co-pending and co-owned U.S. patent application Ser. No. 14/802,073, titled "Interlocking Wall Panels for Modular Building Units," the specification of which is incorporated herein by reference in its entirety.

In order to mate with bottom long rails 114*a*, floor joists 200 are provided a notch 212 at each end that removes a portion of top horizontal support wall 208 and flange wall 210. Thus, the top surface of top wall 208 of floor joists 200 aligns with the top surface of top wall 173 of bottom long rails 114*a*, while the end portions of each floor joist 200 extend into the body of bottom long rails 114*a* and abut the interior of vertical wall 172. Within bottom long rails 114*a*, the bottom surface of bottom wall 202 of floor joists 200 is supported by upwardly bent portion 171 of bottom long rails 114*a*, and the top surface of notch 212 sits directly below top wall 173 of bottom long rails 114*a*. Floor joists 200 may be tack welded in place to bottom long rails 114*a* to provide a permanent connection between the two in a manner well known to those of ordinary skill in the art.

As shown in FIGS. 10 through 13, bottom long rail 114*a* may be provided structural reinforcement in the form of rigid reinforcement plates to add structural rigidity to the frame of the modular building unit, particularly at end regions 115 adjacent to the corners of the frame and to the forklift pockets 140. More particularly, bottom long rails 114*a* may receive an upper horizontal reinforcement plate 160 and a lower horizontal reinforcement plate 162 in end regions 115 and along forklift pockets 140. Bottom long rails 114*a* may further receive a vertical reinforcement plate 164 in end regions 115 to provide further structural support. In these regions of added structural support, and with particular reference to FIG. 13, floor joists 200 may be shortened at their side edges but cutting an end from notch surface 212, vertical wall 206, and bottom wall 202 of floor joist 200 so as to allow the floor joists in such reinforced regions to come in direct contact with those reinforcement members. Floor joists 200 may then be rigidly attached to the reinforcements, such as by tack welding, to provide a rigid, structurally integrated support frame.

The foregoing configuration results in a modular building construction that avoids the need to turn the floor assembly frame over for installation of a floor subsheet, and that likewise provides a modular floor subsheet that may be fitted to the modular building unit without welding, rivets, screws, or other tooling. Such assembly allows all components of the floor to be installed from above, thus avoiding the need to invert the frame of the floor assembly during installation. Likewise, the modular nature of the assembly allows installation to be carried out by fewer personnel than required in traditional installations.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

The invention claimed is:

1. A floor assembly for a modular building unit, comprising:

bottom rails forming a perimeter of said floor assembly; and a plurality of floor joists extending between two of said bottom rails, each said floor joist further comprising a bottom generally horizontal wall, a horizontal slot wall above said bottom wall extending over a portion of said bottom wall and forming a slot between said slot wall and said bottom wall, a vertical wall extending upward from said slot wall, and a top horizontal floor support wall extending outward from said vertical wall;

a plurality of sub-floor sheets positioned between adjacent floor joists, wherein a first edge of a first sub-floor sheet is positioned within said slot, and wherein a second edge of said sub-floor sheet is positioned on a top surface of said slot wall; and a removable fastener extending through said vertical wall of said floor joist above said second edge of said sub-floor sheet and positioned to block upward movement of said second edge of said sub-floor sheet.

2. The floor assembly of claim 1, further comprising a plurality of forklift pockets extending through said floor assembly parallel to said plurality of floor joists.

3. The floor assembly of claim 1, further comprising floor boards positioned on top of said top wall of said floor joists.

4. The floor assembly of claim 1, wherein a plurality of said floor joists extending into a body of said bottom rails.

5. The floor assembly of claim 4, wherein said bottom rails further comprise a rail bottom wall having a base portion and an upwardly bent portion, a rail vertical wall extending upward from said base portion, and a top horizontal wall extending inward from a top end of said vertical wall.

6. The floor assembly of claim 5, wherein a bottom surface of said bottom wall of said floor joists is supported by said upwardly bent portion of said rail bottom wall.

7. The floor assembly of claim 5, wherein said top wall of said floor joists is notched in a region of said floor joist that extends into said body of said bottom rails.

8. The floor assembly of claim 5, wherein said floor joists are welded to said bottom rails.

9. The floor assembly of claim 1, said bottom rails further comprising reinforcement plates extending along only a portion of an interior of said bottom rails in an end region of said bottom rails adjacent corners of said floor assembly.

10. A modular building unit, comprising:

a rigid, fixed modular building unit frame having a plurality of corner support posts, a bottom rail extending between adjacent pairs of corner support posts and forming a perimeter of a floor assembly, a top rail extending between adjacent pairs of corner support posts, and a plurality of wall panels extending between said corner support posts, said top rails, and said bottom rails; and a plurality of floor joists extending between two of said bottom rails, each said floor joist further comprising a bottom generally horizontal wall, a horizontal slot wall above said bottom wall extending over a portion of said bottom wall and forming a slot between said slot wall and said bottom wall, a vertical wall extending upward from said slot wall, and a top horizontal floor support wall extending outward from said vertical wall;

a plurality of sub-floor sheets positioned between adjacent floor joists, wherein a first edge of a first sub-floor sheet is positioned within said slot, and wherein a second edge of said sub-floor sheet is positioned on a top surface of said slot wall; and a removable fastener extending through said vertical wall of said floor joist above said second edge of said sub-floor sheet and positioned to block upward movement of said second edge of said sub-floor sheet.

11. The modular building unit of claim 10, further comprising a plurality of forklift pockets extending through said floor assembly parallel to said plurality of floor joists.

12. The modular building unit of claim 10, further comprising floor boards positioned on top of said top wall of said floor joists.

13. The modular building unit of claim 10, wherein a plurality of said floor joists extending into a body of said bottom rails.

14. The modular building unit of claim 13, wherein said bottom rails further comprise a rail bottom wall having a base portion and an upwardly bent portion, a rail vertical wall extending upward from said base portion, and a top horizontal wall extending inward from a top end of said vertical wall.

15. The modular building unit of claim 14, wherein a bottom surface of said bottom wall of said floor joists is supported by said upwardly bent portion of said rail bottom wall.

16. The modular building unit of claim 14, wherein said top wall of said floor joists is notched in a region of said floor joist that extends into said body of said bottom rails.

17. The modular building unit of claim 14, wherein said floor joists are welded to said bottom rails.

18. The modular building unit of claim 10, said bottom rails further comprising reinforcement plates extending along only a portion of an interior of said bottom rails in an end region of said bottom rails adjacent corners of said floor assembly.

* * * * *